United States Patent [19]

Buttgereit

[11] Patent Number: 4,595,077

[45] Date of Patent: Jun. 17, 1986

[54] SCAFFOLD

[75] Inventor: Klaus Buttgereit, Plettenberg, Fed. Rep. of Germany

[73] Assignee: Plettac GmbH, Stahlbau und Gesenkschmiede, Plettenberg, Fed. Rep. of Germany

[21] Appl. No.: 538,412

[22] Filed: Oct. 3, 1983

[30] Foreign Application Priority Data

Oct. 4, 1982 [DE] Fed. Rep. of Germany ..... 3236648

[51] Int. Cl.[4] ..... E04G 7/30

[52] U.S. Cl. ..... 182/179; 403/49

[58] Field of Search ..... 182/179, 178; 403/49, 403/246

[56] References Cited

U.S. PATENT DOCUMENTS

| | | | |
|---|---|---|---|
| 1,674,734 | 6/1928 | Maynes | 182/179 |
| 4,180,342 | 12/1979 | Layher | 403/49 |
| 4,273,463 | 6/1981 | Dobersch | 182/179 |
| 4,369,859 | 1/1983 | Smits | 403/49 |
| 4,439,052 | 3/1984 | Wallther | 182/179 |

FOREIGN PATENT DOCUMENTS

| | | | |
|---|---|---|---|
| 2822676 | 11/1979 | Fed. Rep. of Germany | 403/49 |
| 2352194 | 1/1978 | France | 403/49 |
| 1427147 | 3/1976 | United Kingdom | 403/49 |
| 2061445 | 5/1981 | United Kingdom | 403/49 |

*Primary Examiner*—Reinaldo P. Machado
*Assistant Examiner*—Alvin Chin-Shue
*Attorney, Agent, or Firm*—Michael J. Striker

[57] ABSTRACT

A scaffold, which is comprised of a plurality of vertical posts and horizontal locking bars crossing those vertical posts, has a plurality of joints at which flanges are arranged to provide connections between the vertical posts and horizontal locking bars. Each flange is rigidly connected to the respective vertical post and has a peripheral portion surrounding the vertical post. This peripheral portion receives a hook of the pawl rigidly connected to the end of the respective horizontal bar and provided with a wedge to ensure engagement of the hook with the peripheral portion of the flange. The thickness of the peripheral portion gradually increases in the upward direction.

14 Claims, 5 Drawing Figures

SCAFFOLD

BACKGROUND OF THE INVENTION

The present invention relates to a scaffold, particularly a scaffold for construction work, which comprises a plurality of vertical posts and a plurality of horizontal and diagonal locking bars connected to each other.

In convential scaffolds for construction work a number of collars or flanges are rigidly arranged on each vertical post, which flanges are vertically spaced from each other. Each flange has a peripheral portion extended outwardly radially from the vertical post and protruding upwardly from the bottom of the flange. The ends of the horizontal and diagonal locking bars are provided with pawls which in assembly engage with the peripheral edges of the respective flanges. The advantage of these known in practice scaffold arrangements is that the pawls provided on the ends of the horizontal and diagonal locking bars can be brought from above into engagement with the rigidly supported vertical posts so that the pawls seize the respective edges of the flanges mounted to the posts. There is also no space required for displacement of the horizontal and diagonal locking bars along the direction of elongation of the respective bars.

A further advantage of these known scaffold constructions resides in that the joint points on the vertical post, which are formed by the flanges surrounding the vertical post and rigidly connected thereto to form the locks provide, after the wedges have been inserted into the respective pawls, very rigid connections and therefore a very rigid and stable scaffold structure as a whole.

In practice, since a great number of vertical posts as well as horizontal and diagonal bars are utilized in one scaffold, it is rather difficult to determine which wedges are tightly inserted into the respective holes formed in the pawls and which wedges are loosely mounted in the holes of the pawls; therefore an operator can not see whether each wedge is rigidly hammered into the pawl of the locking bar or it is loose. It can happen during the assembly of the scaffold that the wedge which was in the beginning tightly hammered in the hole of the pawl will then loosen, which would lead to a play in the connection. The disadvantage of these scaffold assemblies is that any pawl of the locking bar could be inadvertently lifted away from the flange on the vertical post and the locking bar could be therefore detached from the vertical post, which is dangerous.

There have been suggested constructions of pawls which do not employ a wedge connection and which should, however, provide a lock against an inadvertent detachment of the pawl from the flange of the vertical post and prevent loosening of the locking bar from the vertical post; these arrangements, however failed to provide rigid joint points whereby a considerable movement play in the region of the connection between the vertical post and the horizontal locking bars has been possible when the scaffold was in an operative position.

SUMMARY OF THE INVENTION

It is an object of the present invention to provide an improved scaffolding construction.

It is a further object of the invention to provide a scaffold employed with a simple and effective means which would assure a lock against possible detachment of the pawl from the flange of the vertical post even with a loosely positioned wedge.

These and other objects of the invention are attained by a scaffold, particularly for construction works, comprising a plurality of vertical tubular bars and a plurality of horizontal and diagonal locking tubular bars, each vertical tubular bar being provided with a plurality of flanges rigidly mounted thereon and spaced from each other in the vertical direction for fastening the horizontal and diagonal locking bars to the vertical bar, each flange having a bottom portion with an opening through which the vertical bar passes, and a peripheral portion extended upwardly from said bottom portion and radially outwardly from said opening, said horizontal and diagonal locking bars each having an end carrying a locking pawl which in assembly engages with the peripheral portion of the respective flange from an inner surface thereof; and a plurality of wedges each being insertable into the respective pawl to rest against an outer surface of said peripheral portion to lock the pawl with the respective flange, the peripheral portion having a greater thickness in the region of an upper edge thereof than in the region of the bottom portion of the flange.

The thickness of the peripheral portion may gradually increase from said bottom portion towards the upper edge of the peripheral portion.

According to still another features of the invention the pawl may be formed with a slot in which the wedge is held in assembly, said slot forming a supporting surface, said supporting surface and said outer surface being adjusted to receive said wedge therebetween.

The wedge may be provided with means for preventing the wedge from being lost.

The wedge may have an end portion bent outwardly and formed with an opening to receive a pin therein, for preventing the wedge from being lost.

The outer surface of the peripheral portion of the flange may be spherically shaped, said wedge having a sickle-shaped configuration which conforms to said outer surface.

The vertical post or bar has a central axis, and according to yet another feature of the invention said inner surface of the peripheral portion may be inclined to said central axis at an acute angle of about 3° to 6°, and said outer surface extending parallel to said central axis, said pawl having a hook engageable with the peripheral portion of the flange, said hook having an end portion which is thickened in the downward direction.

A distance in the radial direction between said inner surface in the region of the upper edge of the peripheral portion and an outer surface of the vertical bar may be greater than the thickest portion of said hook.

The peripheral portion of the flange may be formed with a bead inwardly radially extended from said inner surface, said pawl having a hook engageable with said bead.

The distance in a radial direction between said inner surface in the region of said bead and an outer surface of the vertical bar may be greater than the thickness of the hook.

Due to the provision of the thickened region in the peripheral portion of the flange it is attained that the pawl in cooperation with the wedge, even when the latter is loose in the hole of the pawl, is rigidly engaged with the edge of the flange so that an undesired disengagement of the pawl from the flange is impossible. A further advantage of the invention is that the respective pawl, with the insertion of the wedge into the hole of the pawl, is engaged with the upper edge of the flange so that an inaccurate and insecure holding, which could be caused by the fact that the pawl engages only with a very small portion of the peripheral portion of the flange, is prevented from occurrence.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENTS

Figure 1:
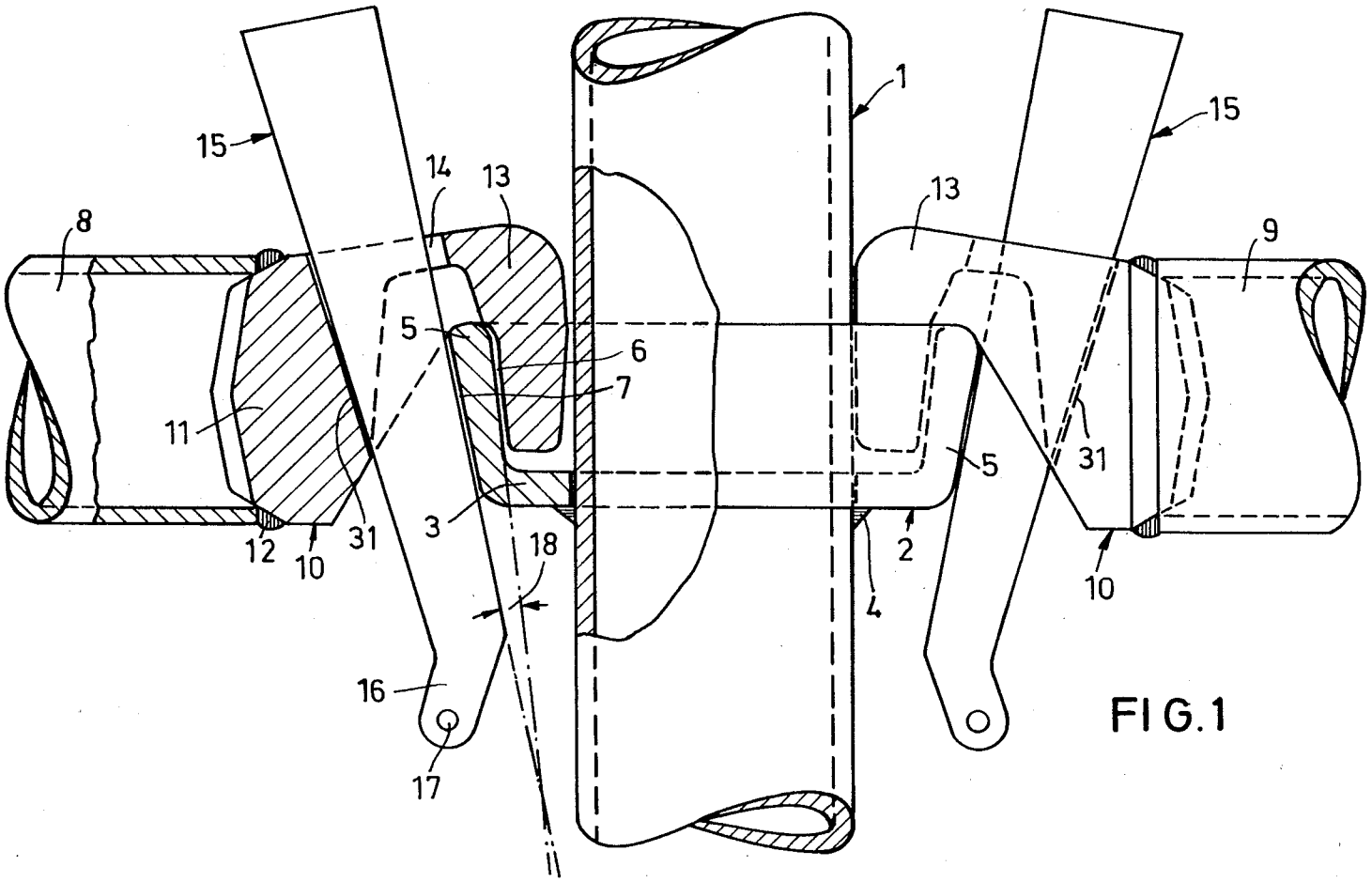
FIG. 1 is a vertical, partially sectional view of a part of the scaffold according to a first embodiment of the invention.

Referring first to FIG. 1, a scaffold according to the invention comprises vertically extended tubular bars 1, on each of which a flange 2 is rigidly mounted, for example by a weld seam 4. It is, of course, understood that a plurality of vertical tubular bars 1 spaced from each other at a predetermined distance as well as a plurality of horizontal locking bars surrounding vertical bars constitute a scaffolding for construction works in a conventional manner. Only a part of the a scaffold is illustrated in the drawings for the sake of simplicity. It is to be understood that a number of flanges 2 are provided on the tubular bar 1, which are spaced from each other at a predetermined distance in the vertical direction.

Each flange 2 has a substantially ring-shaped bottom 3 formed with an opening of the diameter corresponding to that of the tubular bar 1 to receive the latter therethrough and a peripheral portion 5 extended upwardly from the bottom 3. The peripheral portion has a cross-section which gradually increases in the upward direction so that the thickness of the peripheral portion 5 in the region of its upper edge is greater than the thickness of portion 5 in the region of bottom 3. Peripheral portion 5 is defined by two surfaces, namely an inner surface 6 and an outer surface 7. These surfaces, as shown in FIG. 1, in a cross-section are defined by the imaginary lines which extend downwardly and include between each other an acute angle 18 which is from 4° to 8°, preferably 6.5°. This angle is selected so as to ensure a self-locking in the scaffold arrangement, which will be explained below.

It is suggested that the inner surface 6 of the peripheral portion 5 of the flange be formed as close to a cylindrical surface as possible. Since the flanges 2 are usually made in practice by forging it is expedient that the inner surface 6 of the spherical portion 5 could be formed so as to extend at an angle of 3° to 6°, preferably 4.5°, to the central axis of the tubular bar/whereby the forged flange could be easily released from a die. The angle included between the outer surface 7 of the peripheral portion 5 of the flange and the central axis of bar 1 is from 8° to 13°, and preferably 11°.

The flange 2 serves for fastening horizontal and diagonal locking bars to vertical bar 1 at the joint point. Two opposite horizontal bars 8 and 9, also made of tubes, are shown in FIG. 1. Each horizontal bar 8, 9 is provided at the end thereof with a locking pawl 10 which includes a substantially massive root or supporting part 11 and a hook 13. Supporting part 11 is adjusted to the free end of the respective horizontal locking bar and is thereafter rigidly connected to that end, for example by weld seam 12. The pawl 10 is formed with a slot 14 through which a wedge 15 can slide in the downward direction. Wedge 15 is thereby held in slot 14 of the pawl. When inserted into slot 14 wedge 15 is positioned between a supporting surface 31 which is one wall of slot 14, and the outer surface 7 of peripheral portion 5 of flange 2. Accordingly, wedge 15 and surfaces 31 and 7 are adjusted to each other.

Wedge 15 should be held between the above mentioned surfaces 31 and 7 so that it would not get lost. Therefore, the lower end portion 16 of wedge 15 is bent outwardly, which is advantageous. The end portion 16 is provided with a hole into which a pin or a bolt 17 can be inserted, the length of which is greater than the width of slot 14.

Figure 2:
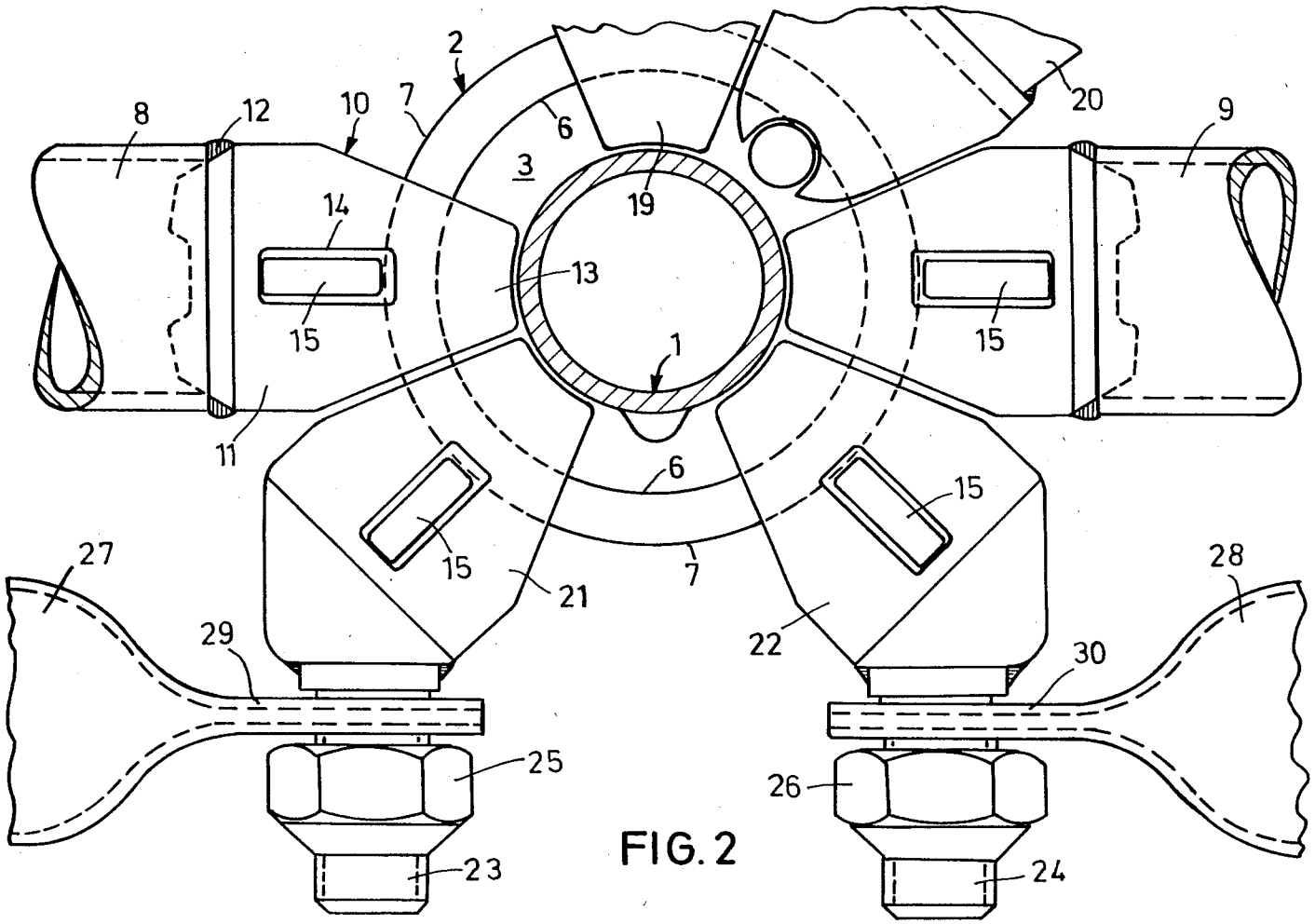
FIG. 2 is a top plan view of the part of the scaffold with a scaffold tube shown in section.

FIG. 2 illustrates a top plan view of the scaffold arrangement shown in FIG. 1. In addition to two oppositely positioned horizontal locking bars 8 and 9 described herein above, additional horizontal bars, for example bar 19, can be provided in the assembly. Each horizontal bar is equipped with the locking pawl similar to the above disclosed pawl 10. If required a diagonally extended horizontal tube 20 can be inserted between bars 9 and 19. Diagonal horizontally extended tubes 27 and 28 are provided with the locking pawls 21 and 22 and the respective wedges inserted in the slots in those locking pawls, in the same fashion as has been described for locking bars 8 and 9. Fastening of locking pawls 21 and 22 with diagonal tubes 27 and 28 is effected, however, not by means of a weld seam but by means of bolts 23 and 24 which are at their ends welded to the supporting parts of the respective pawls 21 and 22 and carry thereon nuts 25 and 26, respectively. Ends 29 and 30 of diagonal tubes 27 and 28 are flattened and formed with the holes which receive threaded bolts 23, 24.

The mode of operation of the above described construction is as follows:

For fastening a horizontally extended or diagonal locking bar to the vertical bar 1, the hook 13 of the respective locking pawl is placed over the peripheral portion 5 of the respective flange, and wedge 15 is held in the upper position. When wedge 15 is released it falls under its own weight and slides downwardly into slot 14 so that the wedge rests, on the one hand, against the outer surface 7 of peripheral portion 5 and, on the other hand, against the supporting surface 31 of supporting part 11 of the pawl. Normally wedge 15 is then rigidly held in position; practice has shown that the hook 13 of pawl 10 slides downwardly unless hook 13 is totally engaged behind the peripheral portion 5. After wedge 15 has been inserted into slot 14 and rigidly secured or more or less locked during the assembly of the scaffold, a so-called self-locking against lifting of the hook is attained due to the thickening of the peripheral portion 5. Even an insignificant displacement of pawl 10 in the upward direction causes hook 13 to rigidly rest against the inner surface 6 of peripheral portion 5 and hook 13 is prevented from a further displacement upwardly because wedge 15 is also tightly supported between surfaces 7 and 31.

Figure 3:
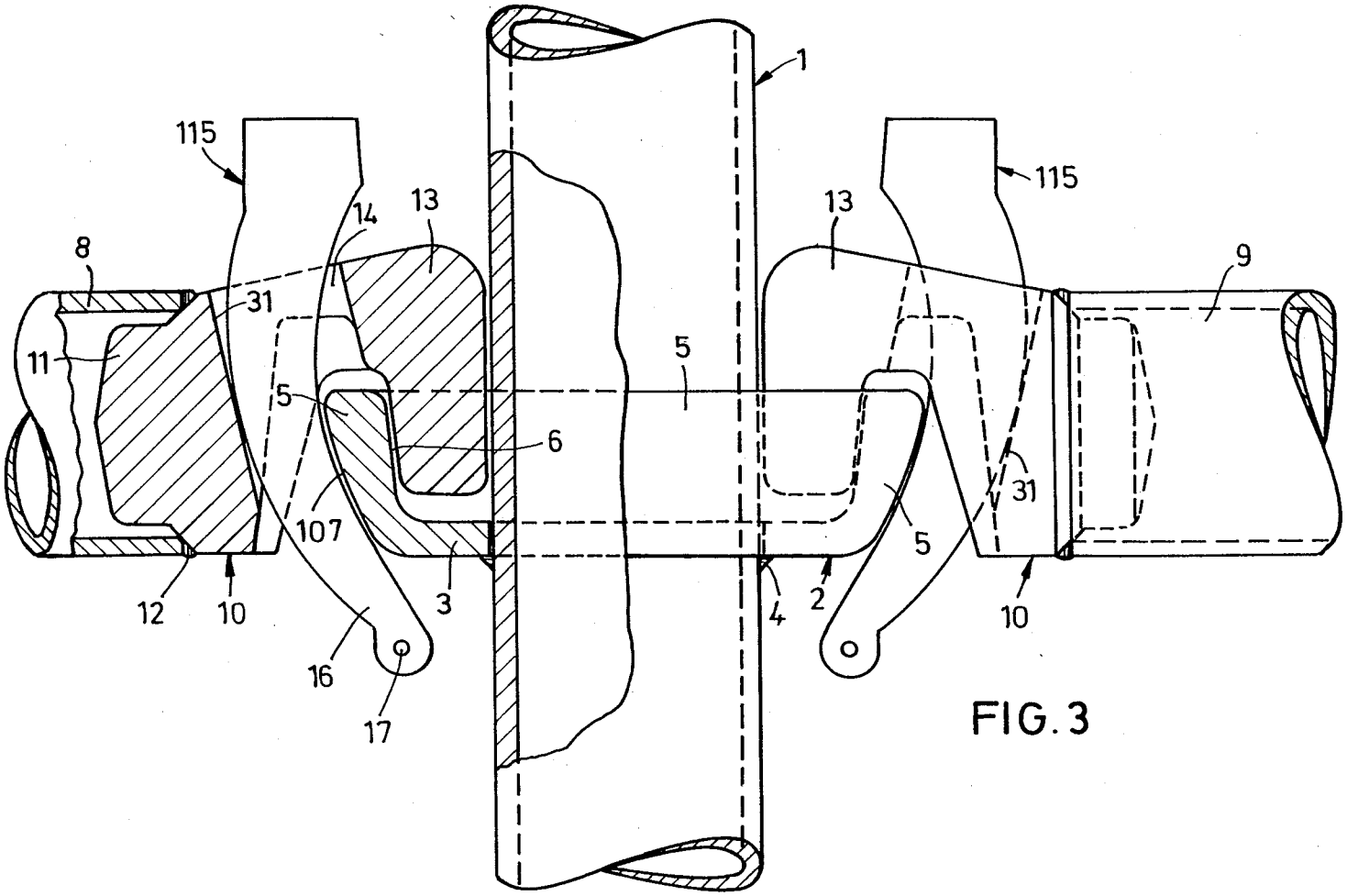
FIG. 3 shows a vertical view similar to FIG. 1 but of a further embodiment of the invention.

FIG. 3 shows a further embodiment of the invention. It should be noted that the vertical bar, horizontal bars, the flange and the pawls illustrated in FIG. 3 have the same reference numerals as those shown in FIGS. 1 and 2. In the embodiment of FIG. 3 the outer peripheral surface 107 of portion 5 of flange 2 is sherically shaped and wedge 115 has a sickle shape so that it matingly complements to the surface 107.

Figure 4:
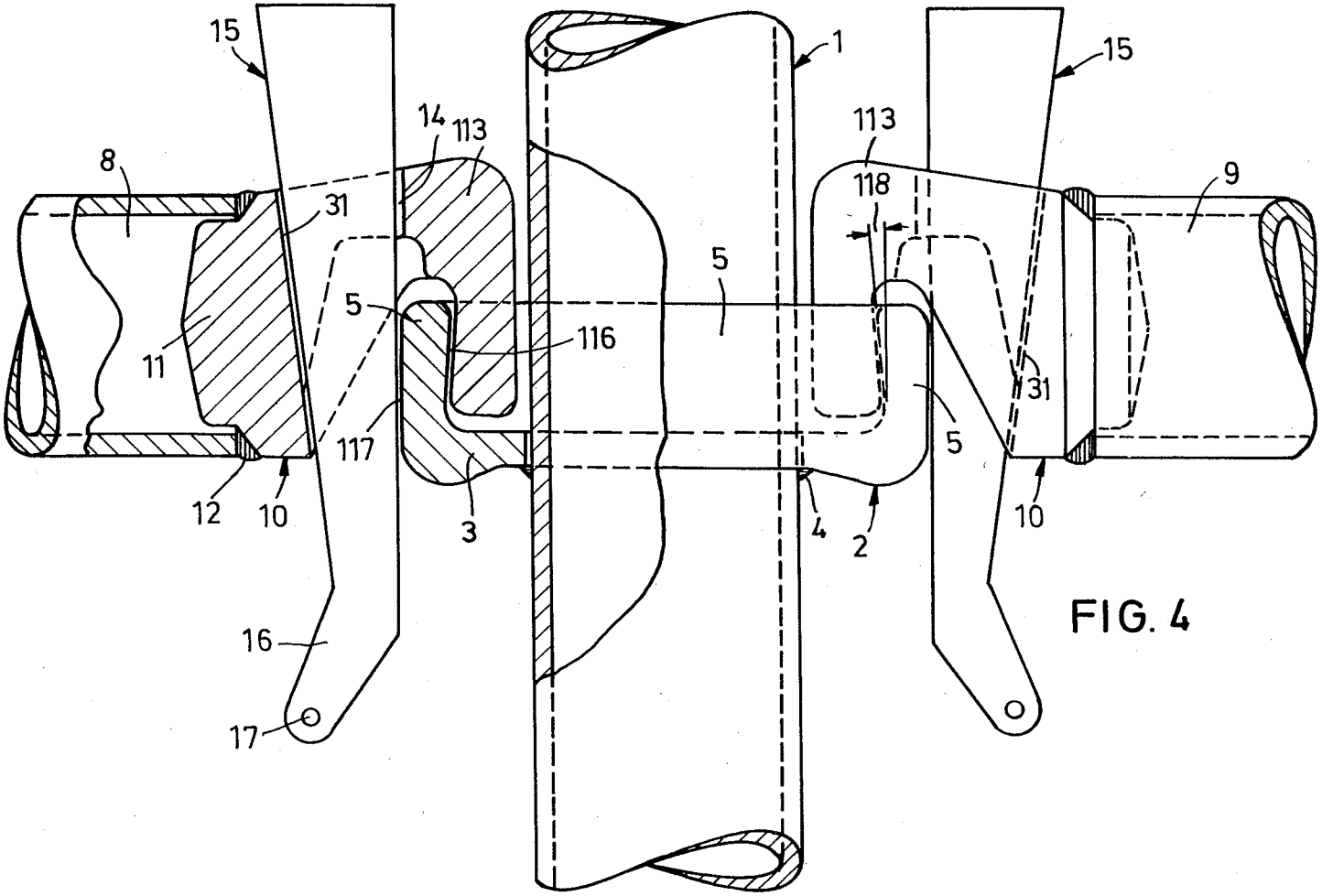
FIG. 4 illustrates still another embodiment of the scaffold structure.

In the embodiment of FIG. 4 the inner surface 116 of the peripheral portion 5 of flange 2 extends at an acute angle 118 to the central axis of the vertical bar 1. This angle may be about 3° to 6°, preferably 5°. The outer surface 117 of the peripheral portion 5 of the flange extends parallel to the central axis of the tubular bar 1. Hook 113 has an end portion, the cross-section of which gradually increases in the downward direction so that this end portion of hook 113 and the peripheral portion 5 of flange 2 have their thickened portions lying against each other and support each other in the direction of locking against a lifting movement. In this embodiment, the distance between the inner rim of the peripheral portion 5 at the upper edge thereof and the outer surface of tubular bar 1 is selected so that this distance is greater than the thickest portion of hook 113 so that the latter can be easily inserted from above behind the peripheral portion 5.

Figure 5:
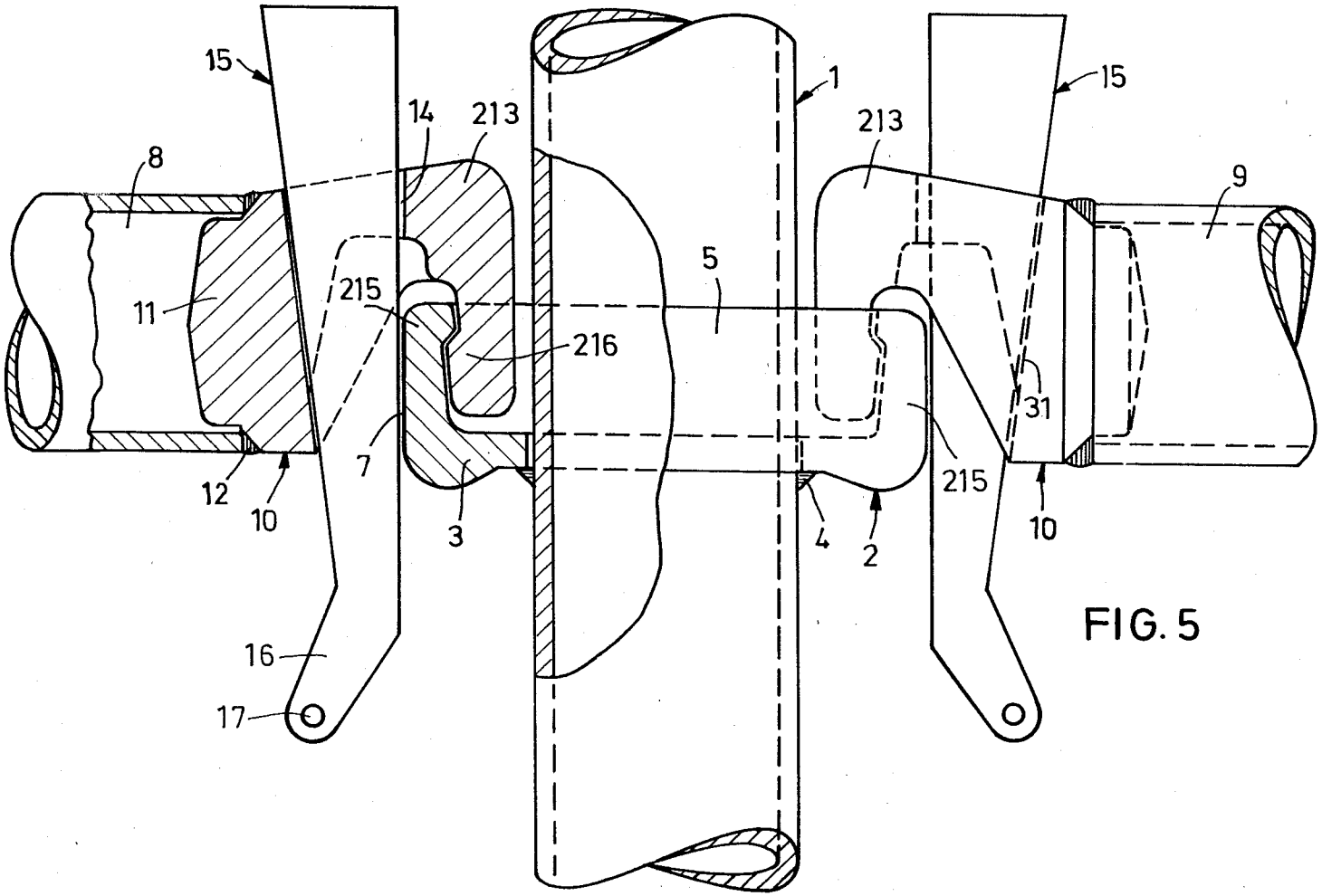
FIG. 5 shows yet another modification of the invention.

FIG. 5 shows a still further embodiment of the invention. With the exception of the wedge and the hook of the pawl all the reference numerals designating the different components of the assembly are the same as in FIGS. 1 through 4. Flange 2 shown in FIG. 5 has the peripheral portion 215 which is formed with a radially inwardly extended projection or bead. Each hook 213 of the each pawl 10 has at its lower end a thickened portion 216 which in assembly is engaged with the bead. In this case the distance between the inner surface of the bead and the outer surface of vertical bar 1 in the radial direction is selected so that this distance is greater than the thickness of portion 216 of hook 213 whereby the hook can be easily inserted from above behind the peripheral portion 215 to be engaged with the bead and to provide a self-locking position of the assembled bars.

I claim:

1. A scaffold, particularly for construction works, comprising a plurality of vertical tubular bars and a plurality of horizontal and diagonal locking tubular bars, each vertical tubular bar being provided with a plurality of flanges rigidly mounted thereon for fastening the horizontal and diagonal locking bars to the vertical bar, each flange having a bottom portion with an opening through which the vertical bar passes, and a peripheral portion extended upwardly from said bottom portion and radially outwardly from said opening, said horizontal and diagonal locking bars each having an end carrying a locking pawl having a hook which extends downwardly and in assembly engages with the peripheral portion of the respective flange from an inner surface thereof; and a plurality of wedges each being vertically insertable into the respective pawl from above to rest against an outer surface of said peripheral portion to lock the pawl with the respective flange, the peripheral portion gradually converging downwardly in cross-section from an upper edge thereof to said bottom portion and having thereby a greater thickness in the region of the upper edge thereof than in the region of the bottom portion of the flange.

2. The scaffold as defined in claim 1, wherein the thickness of the peripheral portion gradually increases from said bottom portion towards the upper edge of the peripheral portion.

3. The scaffold as defined in claim 2, wherein said inner surface and said outer surface are defined in a cross-section by imaginary lines which extend from said upper edge downwardly at an acute angle towards each other.

4. The scaffold as defined in claim 3, wherein said angle is in the range of 4° to 8°.

5. The scaffold as defined in claim 4, wherein said angle is 6.5°.

6. The scaffold as defined in claim 3, wherein the vertical bar has a central axis, said inner surface including with said central axis a first acute angle from 3° to 6° and said outer surface including with said central axis a second acute angle from 8° to 13°.

7. The scaffold as defined in claim 6, wherein said first acute angle is 4.5° and said second acute angle is 11°.

8. The scaffold as defined in claim 1, wherein the pawl is formed with a slot in which the wedge is held in assembly, said slot forming a supporting surface, said supporting surface and said outer surface being adjusted to each other so as to receive said wedge therebetween in only one predetermined position.

9. The scaffold as defined in claim 8, wherein said wedge is provided with means for preventing the wedge from being lost.

10. The scaffold as defined in claim 9, wherein said wedge has an end portion bent outwardly and formed with an opening to receive a pin therein, for preventing the wedge from being lost.

11. The scaffold as defined in claim 2, wherein said outer surface is spherically-shaped, said wedge having a sickle-shaped configuration which conforms to said outer surface.

12. The scaffold as defined in claim 3, wherein the vertical bar has a central axis, said inner surface being inclined to said central axis at an acute angle of about 3° to 6° and said outer surface extending parallel to said central axis, said hook having an end portion which is thickened in the downward direction.

13. The scaffold as defined in claim 12, wherein a distance in the radial direction between said inner surface in the region of the upper edge of the peripheral portion and an outer surface of the vertical bar is greater than the thickest portion of said hook.

14. A scaffold, particularly for construction works, comprising a plurality of vertical tubular bars and a plurality of horizontal and a diagonal locking tubular bars, each vertical tubular bar being provided with a plurality of flanges rigidly mounted thereon for fastening the horizontal and diagonal locking bars to the vertical bar, each flange having a bottom portion with an opening through which the vertical bar passes, and a peripheral portion extended upwardly from said bottom portion and radially outwardly from said opening, said horizontal and a diagonal locking bars each having an end carrying a locking pawl having a hook which extends downwardly and in assembly engages with the peripheral portion of the respective flange from an inner surface thereof; and a plurality of wedges each being vertically insertable into the respective locking pawl from above to rest against an outer surface of said peripheral portion to lock the pawl with the respective flange, the peripheral portion having a greater thickness in the region of an upper edge thereof than in the region of the bottom portion of the flange, the thickness of the peripheral portion gradually decreasing from said upper edge towards said bottom portion up to a lower edge of said portion, and said inner surface and said outer surface defining with each other an acute angle, whereby when a wedge is inserted into the locking pawl and the hook is engaged with the peripheral portion of the flange a reliable self-clamping of said pawl, said flange and said wedge is obtained.

* * * * *